US008443736B2

(12) United States Patent
Martenson

(10) Patent No.: US 8,443,736 B2
(45) Date of Patent: May 21, 2013

(54) FURNITURE-SUPPORTED RETRACTABLE PLATFORM ASSEMBLY

(76) Inventor: Susan A. Martenson, Eden, UT (US)

( * ) Notice: Subject to any disclaimer, the term of this patent is extended or adjusted under 35 U.S.C. 154(b) by 62 days.

(21) Appl. No.: 13/161,331

(22) Filed: Jun. 15, 2011

(65) Prior Publication Data

US 2011/0303126 A1 Dec. 15, 2011

Related U.S. Application Data

(60) Provisional application No. 61/355,135, filed on Jun. 15, 2010, provisional application No. 61/380,543, filed on Sep. 7, 2010.

(51) Int. Cl.
*A47B 23/00* (2006.01)

(52) U.S. Cl.
USPC ..... 108/49; 108/48; 108/152

(58) Field of Classification Search
USPC ..... 108/49, 42, 47, 48, 152, 33, 34, 35, 108/69, 143, 115; 119/847, 28.1; 5/19, 185, 5/658
See application file for complete search history.

(56) References Cited

U.S. PATENT DOCUMENTS 2,562,333 A * 7/1951 Ries ..... 5/504.1
2,576,455 A * 11/1951 Gratt ..... 5/701
3,125,040 A * 3/1964 Roberson ..... 108/47
3,435,469 A 4/1969 Fricke
3,609,892 A * 10/1971 caire ..... 108/71
3,885,256 A 5/1975 Du Boff
3,961,385 A 6/1976 Ferry
3,997,211 A 12/1976 Graves
5,001,795 A 3/1991 Kasten
5,161,484 A * 11/1992 Duane ..... 119/28.5
5,213,060 A * 5/1993 Sloan et al. ..... 119/847
5,426,800 A 6/1995 St. John et al.
D375,388 S * 11/1996 Tsugita ..... D30/118
5,680,660 A 10/1997 Johanknecht
5,699,565 A 12/1997 Petterborg
5,774,913 A 7/1998 Allen et al.
5,775,034 A * 7/1998 Logue ..... 108/48
6,161,486 A * 12/2000 Boots ..... 108/48
6,536,372 B1 * 3/2003 Loeser ..... 119/28.5
6,968,810 B2 * 11/2005 Bishop ..... 119/847
7,096,527 B2 8/2006 Malik
7,628,439 B1 * 12/2009 Strong ..... 108/44
8,100,062 B1 * 1/2012 Anghel ..... 108/69

* cited by examiner

*Primary Examiner* — Jose V Chen
(74) *Attorney, Agent, or Firm* — David W. Barman

(57) ABSTRACT

A platform assembly is suitable for insertion and retention between a lower furniture support, such a boxspring of a bed, and an upper furniture support, such as a mattress of a bed. The platform assembly has a housing and a platform provided with foldable legs. When withdrawn from the housing with the legs in the unfolded position and resting on the floor, the platform is able to support a load, such as blankets, pillows, suitcases and the like, and even a pet or small child.

16 Claims, 6 Drawing Sheets

FURNITURE-SUPPORTED RETRACTABLE PLATFORM ASSEMBLY

RELATED APPLICATIONS

The present invention claims priority to U.S. Provisional patent application No. 61/355,135, filed Jun. 15, 2010, and also to U.S. Provisional patent application No. 61/380,543, filed Sep. 7, 2010.

BACKGROUND

The present invention is directed to a platform assembly of the sort that may be supported by coupling to furniture, such as a bed.

SUMMARY

In one aspect, the invention is directed to a retractable platform assembly having a thickness suitable for insertion and storage between a lower furniture support and an upper furniture support. The platform assembly comprises a housing top and a housing bottom connected to one another, the housing having a housing depth, a housing width and a housing height, wherein the housing height is substantially smaller than either the housing depth or housing width. The assembly also includes an opening formed between the housing top and the housing bottom, the opening having an opening height and an opening width, and a platform member adjustable between a stored position in which the platform member is housed within the housing, and a deployed position in which the platform member is withdrawn from the housing. The platform member comprises a platform having a platform front and a platform rear which together define a direction of insertion and withdrawal relative to the opening; and one or more legs pivotally connected to the platform. When the platform member is the deployed position, the one or more legs are adjustable between a first, folded position in which the platform and the one or more legs are capable of being accommodated in the housing and a second, unfolded position in which the one or more legs are capable of resting on a floor and supporting a load placed on the platform.

DETAILED DESCRIPTION

Figure 1:
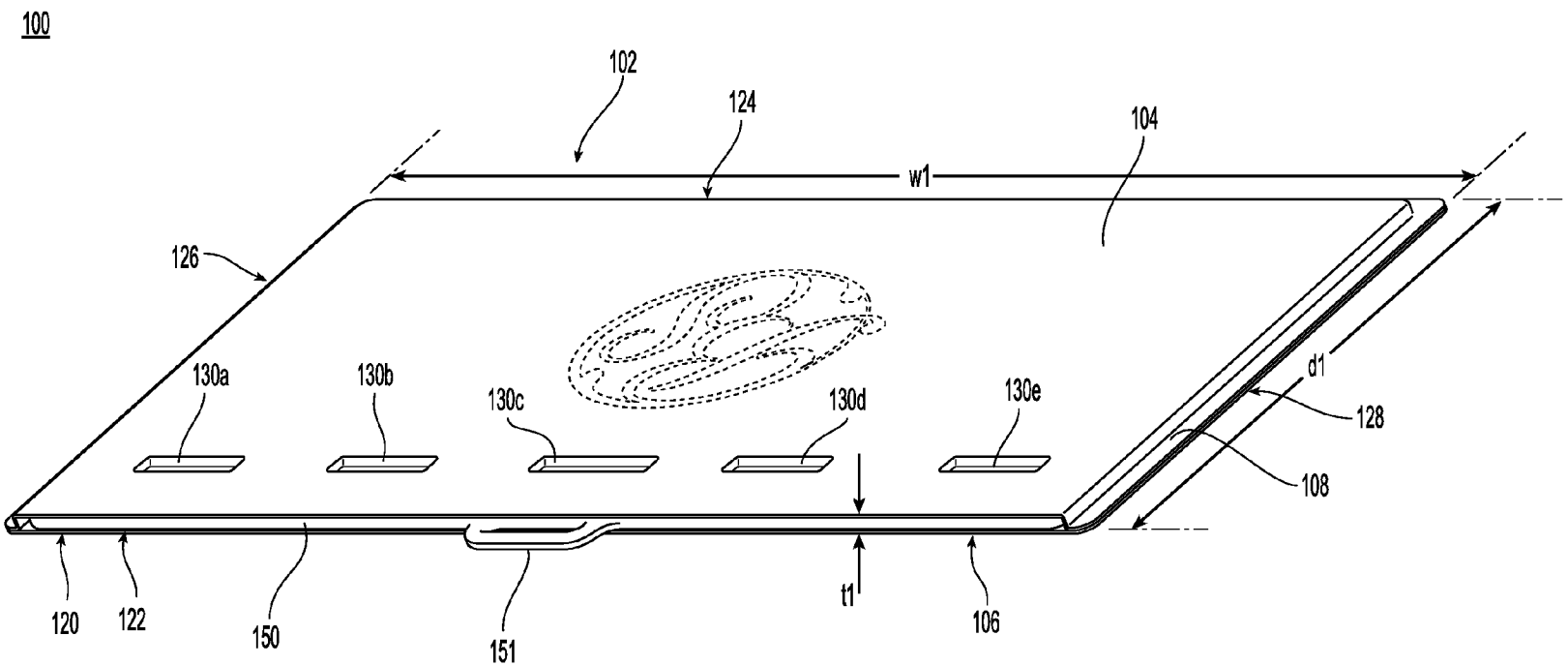
FIG. 1 shows one embodiment of a platform assembly in accordance with the present invention, with the retractable platform stored in the housing.

FIG. 1 shows as assembled view of a platform assembly 100 in accordance with one embodiment of the present invention. The assembly 100 includes a housing 102 having a generally flat rectangular shape with a housing width w1, a housing depth d1 and a housing thickness t1. The thickness t1 is much smaller than either the width w1 or the depth w2. In some embodiments, the housing width of w1 is greater than housing depth d1.

The housing 102 includes a housing top 104 connected to a housing bottom 106. As seen in the embodiment of FIG. 1, the housing top 104 is provided with a flange 108 which extends on three sides and connects to the housing bottom 106 which is shown as being flat in the embodiment of FIG. 1. It is understood, however, that the housing top and housing bottom may instead be connected by discrete vertically extending walls, or may even have a complementary wall shapes which mate to form a "clam-shell". The housing has a housing front 120 provided with a rectangular slot-like housing opening 122, a housing rear 124 and housing sides 126, 128.

The housing top 104, housing bottom 106 and housing opening 122 define a housing compartment. The housing opening 122 has an opening width and an opening height, each slightly smaller than the dimensions of the corresponding housing width w and housing thickness t. As seen in FIG. 1, a retractable platform member 150 occupies, and thus is housed in, the housing compartment when in the stored position. The platform member 150 may be withdrawn from the housing by pulling on platform member handle 151.

The housing top 104 and bottom 106 may be formed from a rigid thermoplastic material, such as Acrylonitrile-Butadine-Styrene (ABS), which may be molded into a desired shape. It is understood, however, that other materials may be used instead.

Proximate its housing front 120, the housing top 104 is provided with a plurality of stops 130A, 130B, 130C, 130D, 130E. Stops 130A-E may be formed as molded formations which extend into the housing compartment. As discussed below, the function of the stops 130A-E is to prevent inadvertent removal of the platform member 150 from the housing 102.

Figure 2:
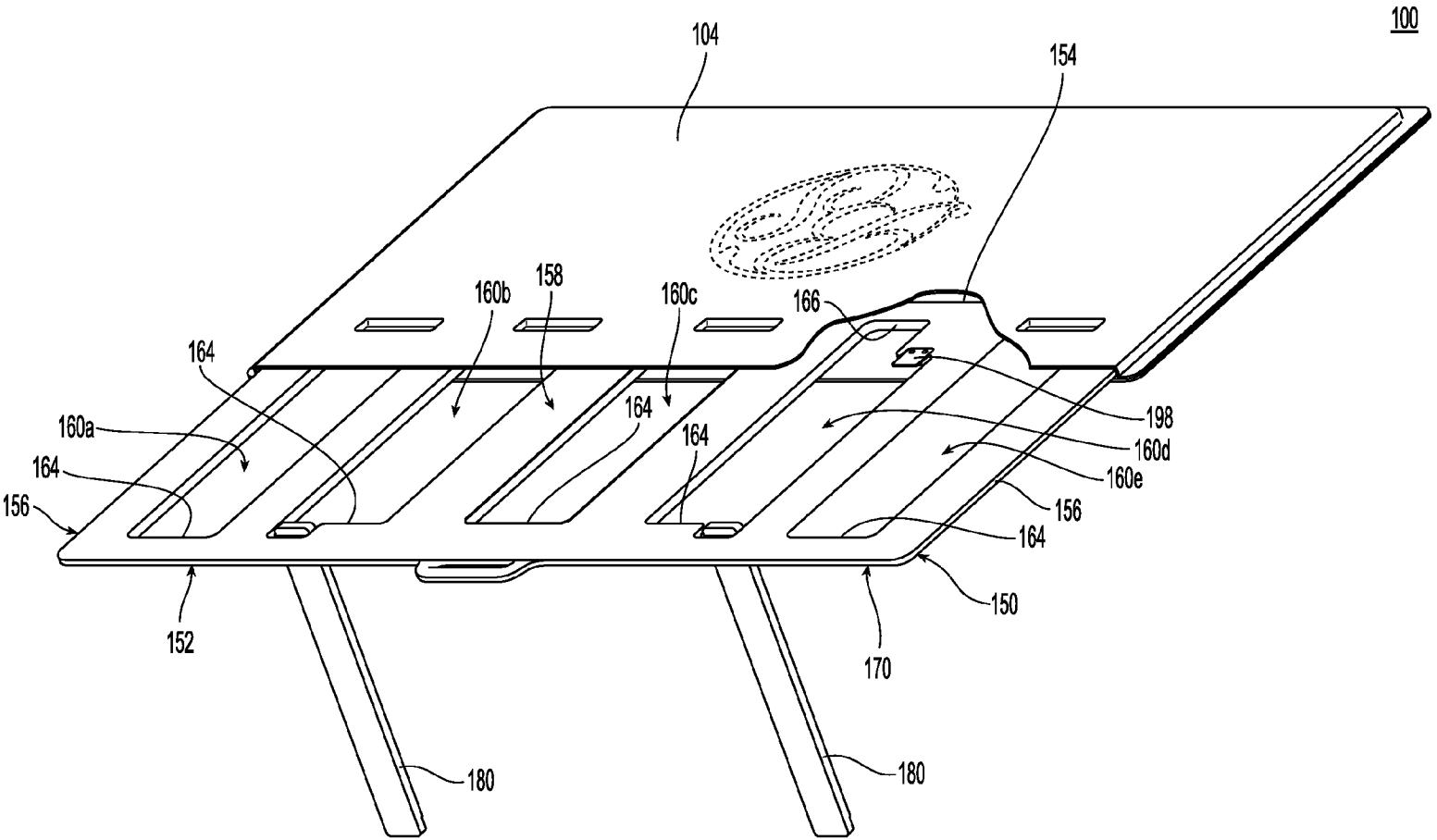
FIG. 2 shows the platform assembly of FIG. 1, with the platform in the deployed position.

FIG. 2 shows the platform member 150 in the deployed position. The platform member 150 includes a platform 170 having a platform front 152, a platform rear 154 and platform sides 156. The platform front 152 and platform 154 define a direction of insertion and withdrawal of the platform member 150 relative to the housing opening 122. The platform 170 also has a top surface 158 and a bottom surface (not labeled in the figures).

A plurality of longitudinally extending elongated openings 160A, 160B, 160C, 160D, 160E extending from proximate the platform front 150 towards the platform rear 154, are formed in the platform 170. The elongated openings 160A-160E each extend between a front edge 164 and a rear edge 166. The rear edge 166 of each elongated opening 160A-160E serves as an abutment surface configured to abut a corresponding one of the stops 130A-103E, when the platform member 150 is withdrawn from the housing 102 to its fullest normal extent. Thus, the abutment surfaces are configured to abut the stops 130A-130E to prevent the platform member 150 from being completely removed from the housing 102.

Figure 3:
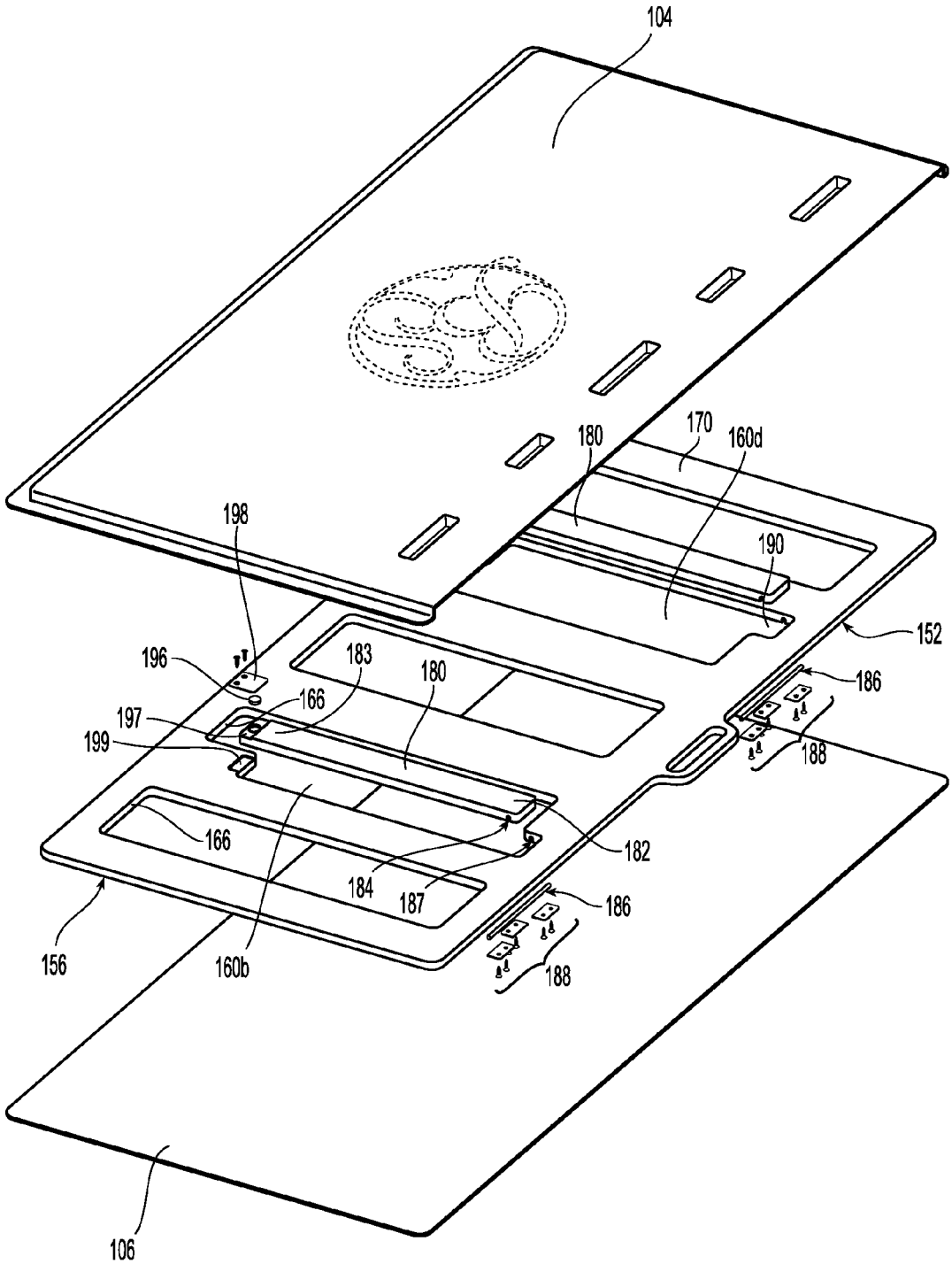
FIG. 3 shows as exploded view of the platform assembly of FIG. 1.
Figure 4:
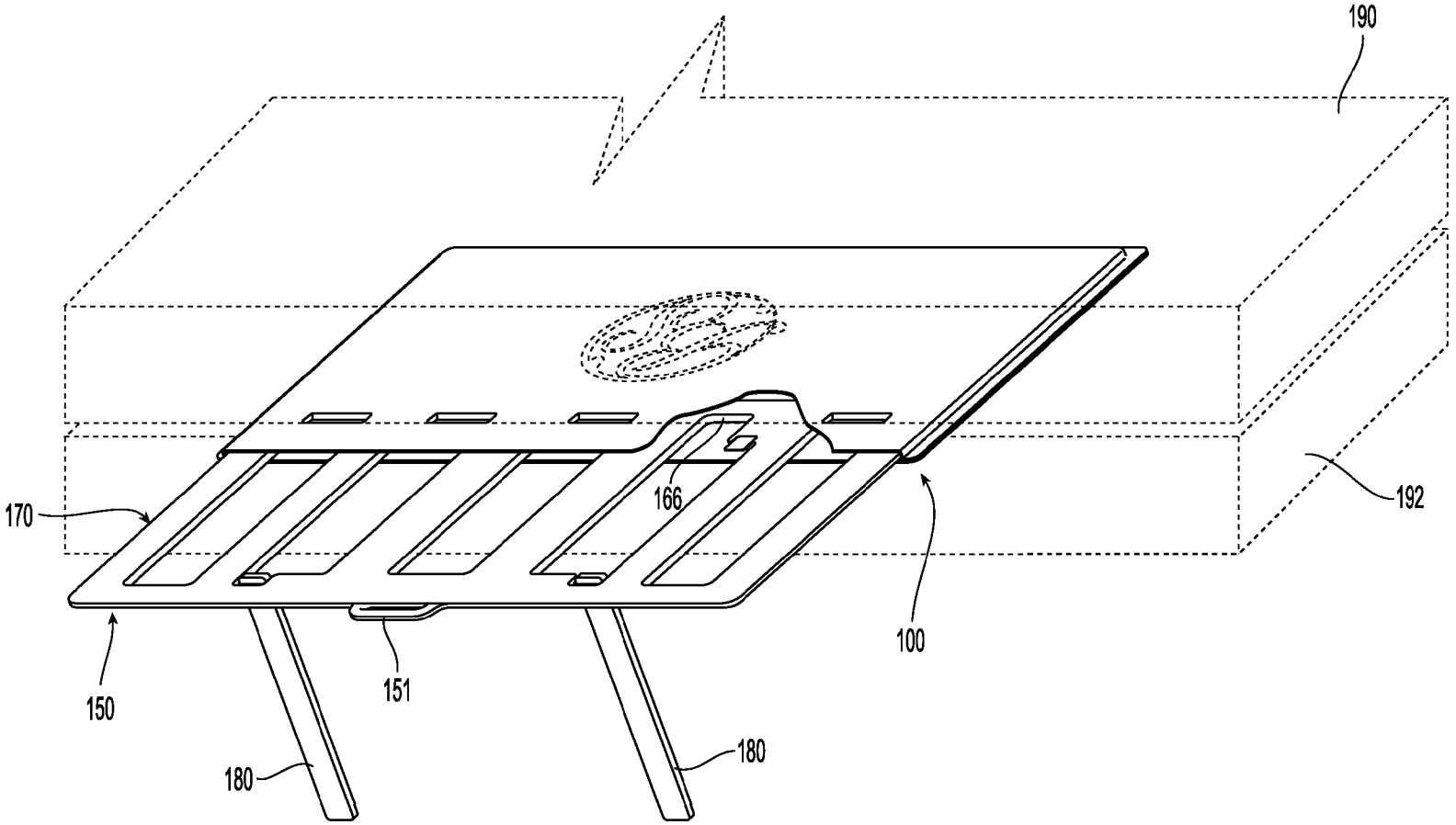
FIG. 4 shows the platform assembly of FIG. 1 with its housing positioned between a lower furniture support and an upper furniture support.

The platform member 150 also includes one or more legs 180 pivotally connected to the platform 170. As seen in the embodiment of FIGS. 2-4, the platform member 150 has two spaced apart legs 180 connected to the platform 170, and accommodated in openings 160B and 160D. Openings 160B and 160D, may be mirror images of each other and have non-rectangular shapes to both accommodate the legs 180 and include the aforementioned abutment surfaces 166.

Each leg 180 has a front (or top) end 182 whose underside is provided with a groove 184. Corresponding grooves 187 are formed in the platform 150 on either side of a cutout 190 formed at the front edge 164 of opening 160B and opening 160D. A hinge rod 186 occupies the leg groove 186 and the platform grooves 187 and is retained to the platform 170 by one or more hinge plates 188. Each leg 180 is thus capable of pivoting about the hinge rod 186 which, in turn, is retained by the hinge plates 188.

Each leg 180 has a rear (or bottom) end 183 on whose upper surface a magnet 196 is positioned. The magnet 196 may be positioned in a suitably-shaped recess 197. A corresponding magnet plate 198 is positioned in a recess 199 formed at the rear edge 166 of the corresponding opening 160B or 160D. The magnet plate 198 is positioned so as to overhang the recess 199 and extend into the opening 160B or 160D. When the leg 180 is pivotally folded up into the opening 160B, 160D, the magnet 196 is magnetically attached to the magnet plate 198, thereby keeping the leg 180 in the folded position for insertion into the housing opening 122. Likewise, when withdrawing the platform assembly 150 from the housing 102, each leg 180 is kept in the folded position by the magnet 198 until such time as the use applies a sufficiently large downward force on the leg to overcome the magnetic force. This facilitates withdrawal and insertion of the platform assembly 150 from and into the housing 102.

Each leg 180 has a thickness substantially similar to that of the platform 170. When in the folded position, by virtue of its thickness, an upper surface of each leg 180 is substantially co-planar with an upper surface of the frame 170, thereby allowing the frame member 150 to have a reduced profile suitable for insertion into the housing 102.

The platform member 150 is adjustable between a stored position in which the platform member is housed within the housing 102, and a deployed position in which the platform member 150 is withdrawn from the housing 102. When in the stored position, the platform 170 and the legs 180 are hidden from view.

When the platform member 150 is in the deployed position, it is withdrawn from the housing and the one or more legs 180 are adjustable between a first, folded position in which the platform member 150 and the one or more legs 180 are capable of being accommodated in the housing 102, and a second, unfolded position in which the one or more legs 180 are capable of resting on a floor and supporting a load placed on the platform 170. In some embodiments, each leg may comprise a telescoping member, which may be capable of being adjusted to any one of several discrete positions to accommodate a particular distance from the housing to the floor.

As seen in FIG. 4, the platform assembly 100 may be positioned between an upper furniture support 190 and a lower furniture support 192. For instance, the upper furniture support 190 may be the mattress of a bed while the lower furniture support 192 may be a box spring or other lower member of a bed. In such case, the platform assembly 100 may be inserted between the mattress and boxspring or other lower member, at the foot of the bed. The weight of the mattress 190 above helps keep the platform assembly from sliding when it is in position, even when pulling out or pushing in the platform member 150. When in the deployed position with the legs down, the platform member may be used to support pillows, sheets, comforters, articles of clothing, and even suitcases or other bags, as needed. In addition, it may serve as a support for a pet cushion and/or a pet.

When designed for use at the foot of a bed, the housing 102 preferably has a housing width w slightly less than the width of the bed's mattress. Thus, generally speaking, the housing may have a housing width w slightly smaller than that of a twin size, full size, queen size or king size mattress. However, to take advantage of the width of a mattress, it may be desirable, though by no means required, for the housing to have a width that is at least 80% of the width of a mattress that is one of twin size, full size, queen size or king size.

The platform assembly may have uses beyond the bed. As another example, the upper furniture support 190 may be a cushion of a sofa while the lower furniture support 192 may be the seating frame of the sofa. Other upper and lower furniture supports may also be employed.

Figure 5:
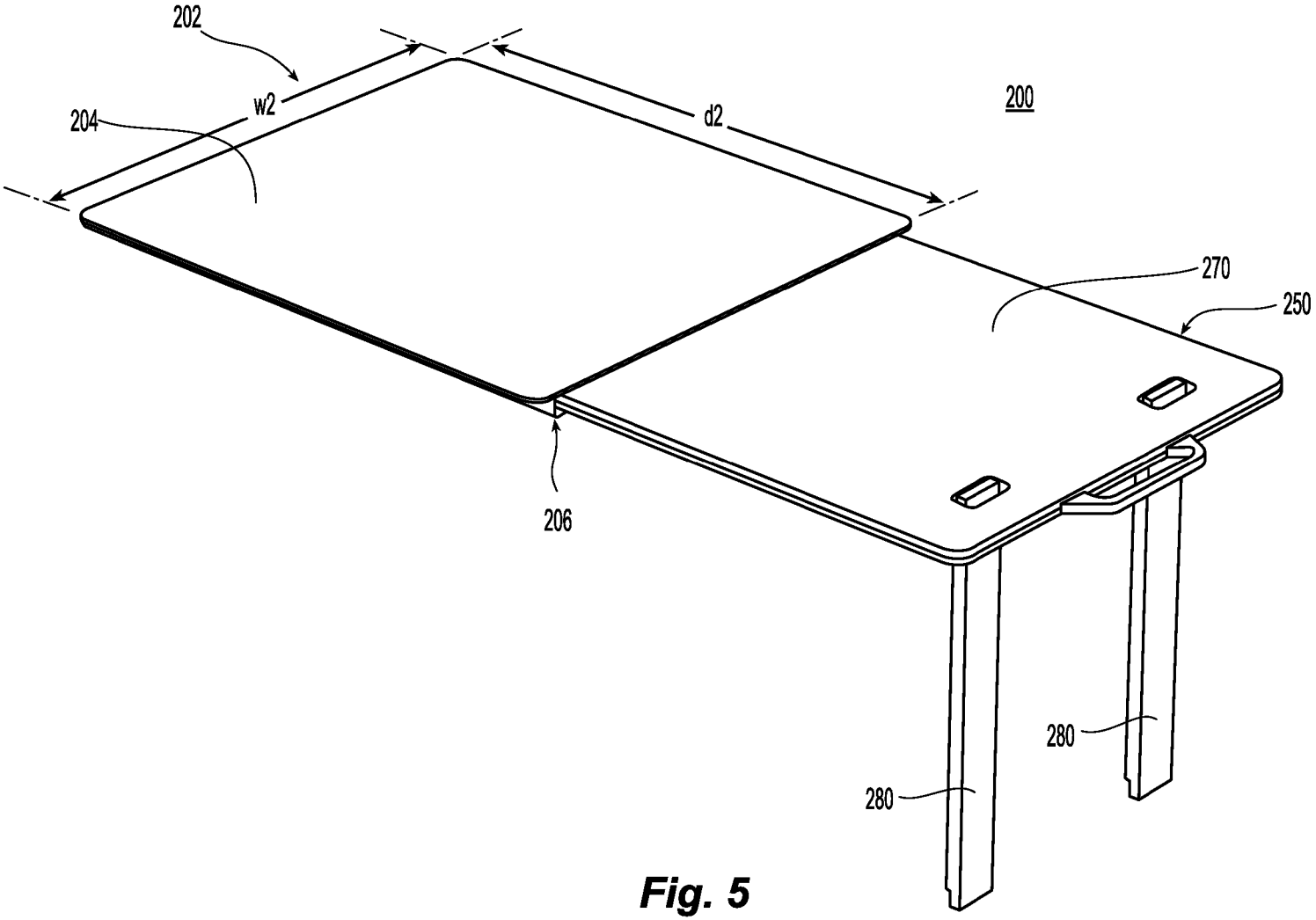
FIG. 5 shows a second embodiment of a platform assembly in accordance with the present invention.

FIG. 5 shows a second embodiment of a platform assembly 200 in accordance with the present invention. Platform assembly 200 includes a housing 202 having a housing top 204 and a housing bottom 206. The housing 202 has a width w2, a depth d2 and a thickness sufficient to accommodate a retractable platform member 250. The depth d3 may be larger than the width d3.

The retractable platform member 250 comprises a platform 270 to which a pair of spaced apart legs 280 are pivotally connected. Platform 270 is formed as a tabletop 270 and so platform assembly 200 is configured to serve as a side table when inserted between upper and lower furniture supports, such as the mattress and boxspring of a bed.

Unlike platform 170 of platform assembly 100 seen in FIGS. 1-4, tabletop 270 is devoid of openings such as the longitudinally extending elongated openings 160A-160E found in platform 170 of platform member 150. Thus, the legs 280, when folded, do not enter such elongated openings formed in the tabletop 270. Instead, the legs 280 are tucked under the tabletop 270 and extend parallel thereto when folded. It is understood, however, that the rear (or bottom) ends of the legs 280 are provided with magnets while the underside of the tabletop 270 is provided with magnet plates to keep the legs 280 in the folded position, in a manner similar to that described with respect to the legs 180 of platform member 150 described above.

Figure 6A:
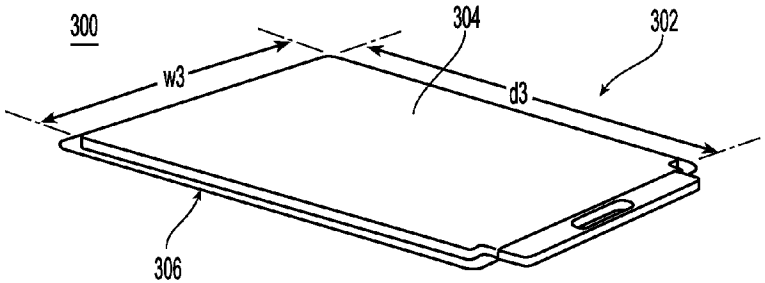
FIGS. 6A, 6B and 6C show a third embodiment of a platform assembly in accordance with the present invention.
Figure 6C:
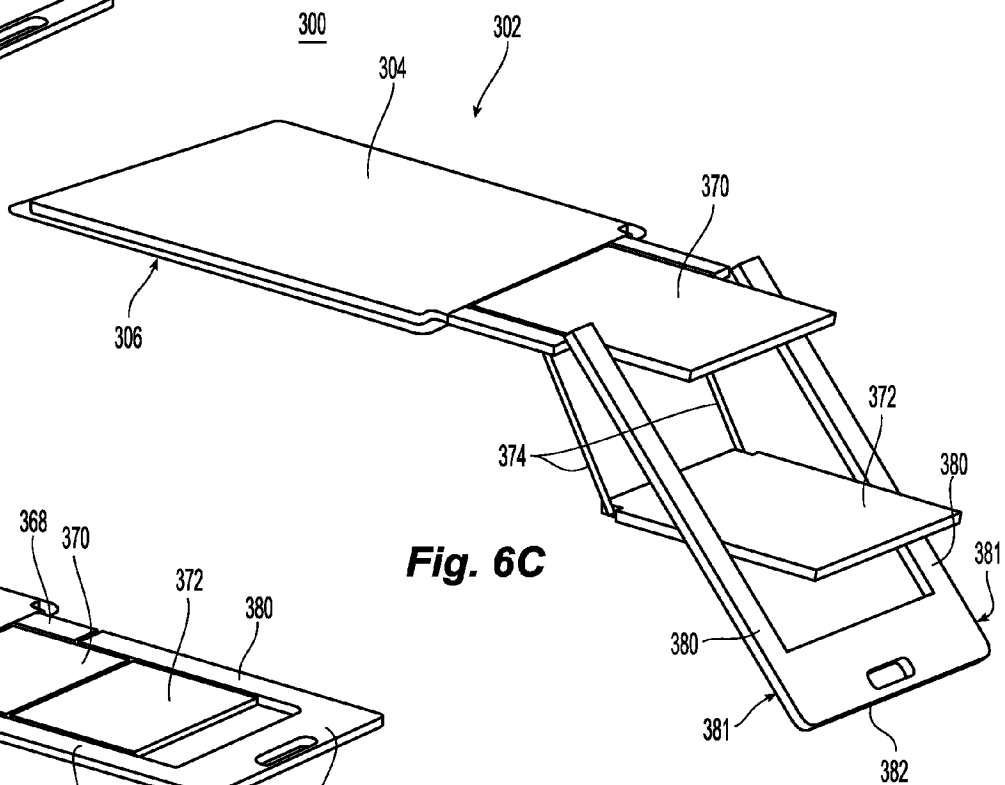
Figure 6B:
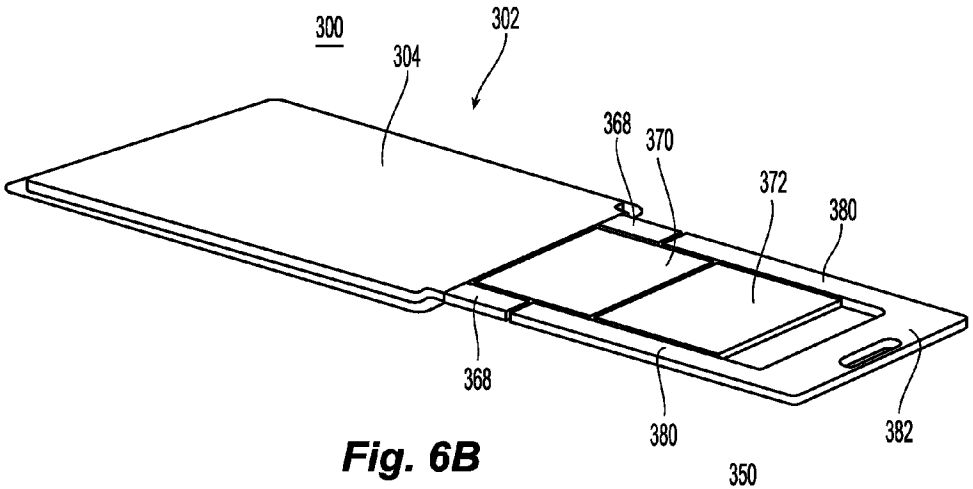

FIGS. 6A, 6B and 6C show a third embodiment of a platform assembly 300 in accordance with the present invention. Platform assembly 300 includes a housing 302 having a housing top 304 and a housing bottom 306. The housing 302 has a width w3, a depth d3 and thickness sufficient to accommodate a retractable platform member 350. The depth d3 may be larger than the width d3.

The platform member 350 comprises a pair of rear frame members 368 bordering either side of a platform 370. A pair of legs 380 are pivotally connected to opposing sides of the platform 370. The legs 380 are connected to one another at their lower ends 381 by a connecting base member 382. The connecting base member 382 is configured to rest on the floor when the platform member 350 is in the deployed position with the legs 380 unfolded.

Platform 370 is formed as a top step 370. As best seen in FIGS. 6B and 6C, a second step 372 is pivotally connected to the legs 280 at a point between the connecting base member 382 and the top step 370. The second step 372 is further supported by a pair of second step supports 374 which are hingedly connected at a rear end to respect rear frame members 368 and at a front end to a rear portion of the second step 372.

Thus, platform assembly 300 with its two-step platform member 350 can serve as a step ladder for a child or a pet to climb onto furniture, when the housing 302 is inserted between upper and lower furniture supports, such as the mattress and boxspring of a bed.

Each of the above-described platform assemblies 100, 200, 300 may be marketed, shipped and sold ready-to-use, with no assembly required.

The foregoing disclosure provides illustrative embodiments of the invention and is not intended to be limiting. It should be understood that modifications of the disclosed embodiments are possible within the spirit and scope of the invention, and the invention should be construed to encompass such modifications.

What is claimed is:

1. A retractable platform assembly having a thickness suitable for insertion and storage between a lower furniture support and an upper furniture support, the platform assembly comprising: a housing top and a housing bottom connected to one another, the housing having a housing depth, a housing width and a housing height, wherein the housing height is substantially smaller than either the housing depth or housing width; an opening formed between the housing top and the housing bottom, the opening having an opening height and an opening width; and a platform member adjustable between a stored position in which the platform member is housed within the housing, and a deployed position in which the platform member is withdrawn from the housing, the platform member comprising: a platform having a platform front and a platform rear which together define a direction of insertion and withdrawal relative to the opening; and two spaced apart legs pivotally connected to the platform, wherein each of the two spaced apart legs has a thickness substantially similar to that of the frame and said pivotable connection allows said legs to be positioned in a first folded position and a second deployed position such that when the legs are in the first, folded position, the legs are coplanar with the platform and further wherein: when the platform member is the deployed position, the legs are adjustable between: said first, folded position in which the platform and the legs are capable of being accommodated in the housing; and the second, unfolded position in which the one or more legs are capable of resting on a floor and supporting a load placed on the platform.

2. The retractable platform assembly according to claim 1, wherein: the housing has a width which is at least 80% of a width of a mattress, said width correlating to width dimension of one of twin size, full size, queen size or a king size mattress.

3. The retractable platform assembly according to claim 1, wherein: when the platform member is in the stored position, the platform and the at least one leg are hidden from view.

4. The retractable platform assembly according to claim 1, wherein: each of the two spaced apart legs has a first end that is pivotally connected to the frame, and a second end provided with a magnet that is configured to attach to a magnet plate provided on the frame.

5. The retractable platform assembly according to claim 1, wherein: each of the two spaced apart legs has a first end that is pivotally connected to the frame, and a second end provided with a magnet that is configured to attach to a magnet plate formed on the frame.

6. The retractable platform assembly according to claim 1, wherein: each of the two spaced apart legs comprises at least one telescoping member.

7. The retractable platform assembly according to claim 1, further comprising: a plurality of spaced apart first stops formed on the housing; and a plurality of abutment surfaces formed on the platform member, wherein: the abutment surfaces are configured to abut the first stops to prevent the platform member from being completely removed from the housing.

8. The retractable platform assembly according to claim 7, wherein: the at least one or more legs comprises exactly two spaced apart legs which are pivotally connected to the platform; the platform has a longitudinally extending elongated opening extending parallel to each leg, when the legs are in the folded position; and an abutment surface is formed on a rear edge of each elongated opening.

9. The retractable platform assembly according to claim 8, wherein: the spaced apart first stops are formed on an underside of the housing top.

10. The retractable platform assembly according to claim 1, wherein: the platform comprises a tabletop devoid of longitudinally extending elongated openings; the legs are pivotally connected to the tabletop.

11. The retractable platform assembly according to claim 1, wherein: the platform comprises a top step; and the legs have a leg step there between, wherein said leg step is positioned between the top step and lower ends of the legs.

12. The retractable platform assembly according to claim 11, wherein: the legs are connected to one another at their lower ends by a connecting base member; and the connecting base member is configured to rest on the floor when the platform member is in the deployed position with the legs unfolded.

13. The retractable platform assembly of claim 11 in combination with a bed, wherein the housing is positioned between a mattress and box spring of the bed.

14. Use of the retractable platform assembly of claim 13, for allowing a child or pet to climb onto the bed.

15. The retractable platform assembly of claim 1 in combination with a bed, wherein the housing is positioned between a mattress and box spring of the bed.

16. Use of the retractable platform assembly of claim 15, for supporting a pet cushion and/or a pet on the platform.

* * * * *